United States Patent [19]

Kakizaki et al.

[11] 4,205,253

[45] May 27, 1980

[54] ELIMINATION OF LANDING ERRORS IN ELECTRON-OPTICAL SYSTEM OF MIXED FIELD TYPE

[75] Inventors: Takehiro Kakizaki, Yokohama; Susumu Tagawa, Atsugi; Masahide Sawai, Ebina, all of Japan

[73] Assignee: Sony Corporation, Tokyo, Japan

[21] Appl. No.: 880,209

[22] Filed: Feb. 22, 1978

[30] Foreign Application Priority Data

Feb. 25, 1977 [JP] Japan ..... 52-20504

[51] Int. Cl.[2] ..... H01J 29/74

[52] U.S. Cl. ..... 313/437; 313/439

[58] Field of Search ..... 313/437, 439, 432, 433

[56] References Cited

U.S. PATENT DOCUMENTS

| | | | |
|---|---|---|---|
| 3,319,110 | 5/1967 | Schlesinger | 313/389 X |
| 3,796,910 | 3/1974 | Ritz | 313/433 X |

*Primary Examiner*—Robert Segal

*Attorney, Agent, or Firm*—Lewis H. Eslinger; Alvin Sinderbrand

[57] ABSTRACT

In an electron-optical system of the mixed field type in which magnetic and electric fields are respectively operative to project a focused image of an object of the system upon a target structure and to simultaneously scan such image across the target structure, beam landing errors are eliminated by dimensioning and locating the solenoid for generating the magnetic field and the electrostatic yoke for generating the electric field so that the landing errors due to non-uniformity of the electric field, for example, by reason of field-free regions at the opposite ends thereof, are substantially cancelled by landing errors due to non-uniformity of the magnetic field, for example, as constituted by flare field regions at the opposite ends of the magnetic field.

3 Claims, 9 Drawing Figures

ELIMINATION OF LANDING ERRORS IN ELECTRON-OPTICAL SYSTEM OF MIXED FIELD TYPE

BACKGROUND OF THE INVENTION

1. Field of the Invention

This invention relates generally to systems for focusing and deflecting electron beams, for example, as in vidicon or image orthicon tubes, and more particularly is directed to an improved electron-optical system of the mixed field type in which a magnetic field focuses a projected electron image of the system object onto a target while simultaneously an electric field deflects the image across the target area.

2. Description of the Prior Art

There have been ever increasing needs for high quality electron-optical systems in many fields. In the case of video camera tubes employing beams of low velocity electrons, electron-optical characteristics, such as, beam spot size, landing error and deflection linearity are of prime importance, and the size and power consumption of the tube are also of importance particularly when the tube is to be incorporated in a portable camera.

From the design standpoint, focus and deflection systems can be provided with any combinations of magnetic and electrostatic or electric fields. An all-magnetic system is used in nearly all conventional vidicons, and the development of this system seems to have progressed as far as possible. For much better performance of the electron-optical system, a new approach seems to be dictated. Generally, magnetic focusing by a long solenoid coil has a higher resolution capability than electrostatic focusing. This results from the relatively smaller aberration of the magnetic lens. On the other hand, electric or electrostatic deflection is advantageous over magnetic deflection in terms of the relatively reduced size and weight of an electrostatic yoke and its lower power consumption.

Therefore, it has been proposed, for example, as disclosed in detail in U.S. Pat. No. 3,319,110, issued May 9, 1967, to provide an electron-optical system of the mixed field type, that is, in which a substantially coaxial electrostatic yoke and solenoid extend along an envelope intermediate a beam source and a target. The solenoid generates a substantially constant magnetic field within and along the axis of the envelope, while the electrostatic yoke generates a variable electric field orthogonal to the magnetic field and capable of causing deflection of the electron beam along two coordinates lying in a plane orthogonal to the enevelope axis. The crossed electric and magnetic fields constitute a so-called "focus projection and scanning" or "FPS" cavity by which a projected electron image of an object of the system defined by an aperture or cross-over of the electron beam is focused on the target structure and, simultaneously, the image is deflected across the target area in accordance with signals applied to the electrostatic yoke. The foregoing electron-optical system is theoretically capable of providing high image resolution and high beam current density with minimum power requirements, size and weight, and with the electron beam, after deflection, traveling along a path parallel with its original path to enable normal or orthogonal landing of the beam on the target. The beam landing angle affects shading, resolution, lag and flicker of camera tubes employing low-velocity electron beams. Normal beam landing is especially necessary in a single tube color camera for obtaining the accurate read out of coded color signals therefrom.

The achievement of normal beam landing in a mixed field electron-optical system, as described above, requires that each of the magnetic and electric fields by precisely uniform. However, as a practical matter, it is not possible to provide magnetic and electric fields that are precisely uniform, particularly in the direction along the envelope axis, with the result that significant and undesirable landing errors occur.

OBJECTS AND SUMMARY OF THE INVENTION

Accordingly, it is an object of the present invention to provide a mixed field electron-optical system, as aforesaid, in which normal beam landing is simply achieved.

More particularly, an object of the invention is to provide a mixed field electron-optical system having non-uniform magnetic and electric fields, and in which normal beam landing is achieved without requiring a collimating or prefocus lens.

Another object is to provide a mixed field electron-optical system, as aforesaid, which provides even higher resolution than that attainable with the theoretically uniform magnetic and electric fields.

In accordance with an aspect of this invention, beam landing errors are eliminated, that is, normal beam landing is maintained, in a mixed field electron-optical system by dimensioning and locating the solenoid for generating the magnetic field and the electrostatic yoke for generating the electric field so that landing errors due to non-uniformity of the electric field, for example, by reason of field-free regions at the opposite ends thereof, are cancelled by landing errors due to non-uniformity of the magnetic field, for example, as a result of flare field regions at the opposite ends of the magnetic field.

The above, and other objects, features and advantages of this invention, will be apparent in the following detailed description of an illustrative embodiment which is to be read in connection with the accompanying drawings:

DESCRIPTION OF A PREFERRED EMBODIMENT

In the case of a mixed field electron-optical system having magnetic and electric fields $-Bz$ and $-Ey$ parallel to the Z and Y axes on FIG. 1 and which are uniform in the direction along the Z-axis, the electron motion is described by the below equations:

$$\ddot{x} = \frac{e}{m}\dot{y}Bz$$
$$\ddot{y} = -\frac{e}{m}(-By + \dot{x}Bz)$$
$$\ddot{z} = 0,$$

in which the dot over x or y indicates differentiation with respect to the time t.

Figure 1:
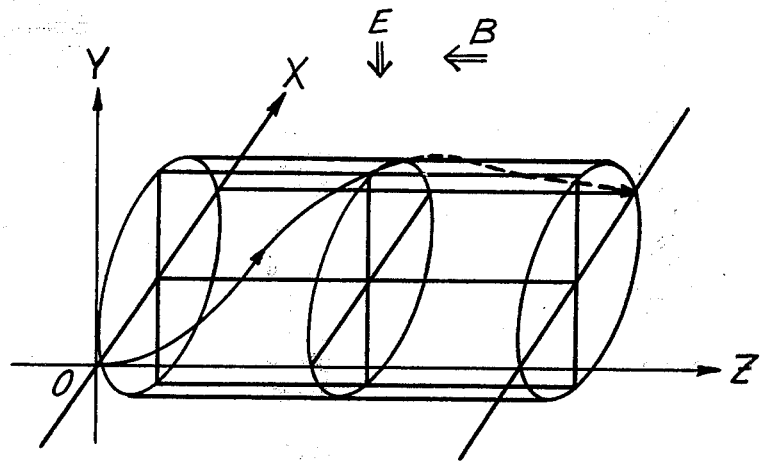
FIG. 1 is a three-dimensional graphic view illustrating the path of an electron beam in theoretically uniform magnetic and electric fields of a mixed field electron-optical system.

Integration of the above equations for electrons having the origin O on FIG. 1 with an initial velocity $(\dot{x}, \dot{y}, \dot{z}) = (v_o \tan\theta \cos\phi, v_o \tan\theta \sin\phi, v_o)$ results in:

$$x = \frac{\alpha}{\omega^2}(\omega t - \sin\omega t) + \frac{v_o\tan\theta}{\omega}[\sin(\omega t - \phi) + \sin\phi]$$
$$y = \frac{\alpha}{\omega^2}(1 - \cos\omega t) + \frac{v_o\tan\theta}{\omega}[\cos(\omega t - \phi) - \cos\phi]$$
$$z = v_o t$$
$$\dot{x} = \frac{\alpha}{\omega}(1 - \cos\omega t) + v_o\tan\theta\cos(\omega t - \phi)$$
$$\dot{y} = \frac{\alpha}{\omega}\sin\omega t - v_o\tan\theta\sin(\omega t - \phi)$$
$$\dot{z} = v_o,$$

in which, $\alpha = e\,EY/m, \omega = e\,Bz/m$, $\theta$ is the beam half angle, and $v_o$ is the axial velocity at the origin.

Figure 2:
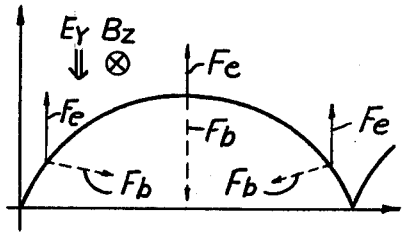
FIG. 2 is a graphic projection, onto a plane normal to the longitudinal axis of the electron-optical system, of the electron beam trajectory or path shown on FIG. 1.

The diverging electrons having the aperture or origin O on FIG. 1 at the same axial velocity $v_o$ drift in the Z-direction at constant velocity because the magnetic and electric fields are assumed to exert no force on the electrons in the direction of the Z-axis. However, in the X-Y plane, the electrons move in paths that are cycloidal or trocoidal depending on whether or not the electrons and axially directed at the origin or aperture 0. As is apparent on FIG. 2 showing a projection of the primary beam trajectory on the XY-plane, and in which the arrows $F_e$ in full lines represent forces due to the electric or electrostatic field and the broken-line arrows $F_b$ represent forces due to the magnetic field, it will be seen that the beam is initially deflected upwardly by the electrostatic field $E_y$ and that such motion is varied to the side and then downward by the magnetic field $B_z$ with the downward motion being decelerated by the electric or electrostatic field. Thus, at the end of a cycle, the velocity component in the XY-plane becomes zero.

From the foregoing, it will be apparent that the electric or electrostatic field acts as both a deflection field and a collimation field. When $t = 2n\pi/\omega$, with n being an integer, the electrons of the beam converge to a focused spot. In the case of the described mixed field electron-optical system, the focal plane is flat from the center to the edges thereof because the electrostatic field $E_y$ has no affect on the focusing action, that is, the system is free of deflection defocus. Further, although the electrostatic field produces a displacement of the electron beam, for example, in the direction of the X-axis, there is no change in direction of the incident beam. Thus, if the beam is directed axially at the origin or aperture O, the primary beam impinges on the target in a direction perpendicular to the plane of the latter, that is, normal beam landing is achieved, for the case where the plane of the target is orthogonal to the Z-axis. Finally, the deflection of the beam by the electrostatic field $E_y$ is directly proportional to the electrostatic field intensity, that is, the deflection of the scan is free of geometric distortions.

All of the foregoing characteristics are particularly advantageous in an electron-optical system for a camera tube. However, orthogonal or normal beam landing, which is of the utmost importance in the case of a camera tube, is only achieved with idealized conditions in the described mixed field electron-optical system, that is, when the magnetic and electric fields are uniform, particularly in the direction along the Z-axis. Such ideal conditions, namely, uniform magnetic and electric fields cannot be readily achieved in practice, from which it follows that considerable difficulty has been experienced in making practical use of the electron-optical system disclosed in U.S. Pat No. 3,319,110.

Figure 3:
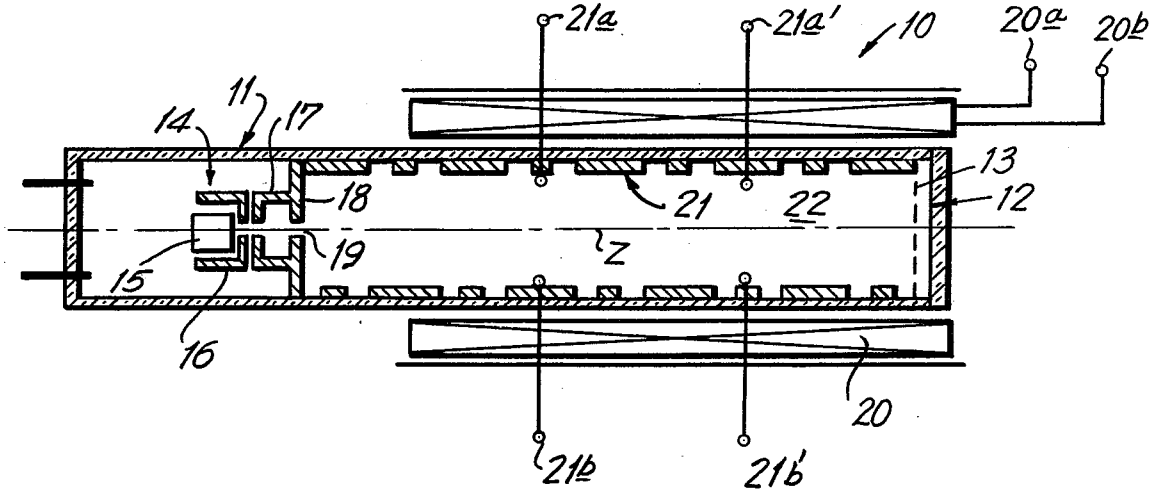
FIG. 3 is a schematic longitudinal sectional view of a vidicon having a mixed field electron-optical system according to this invention.

The reasons why the magnetic and electric fields cannot be readily made uniform and the elimination of the landing error in accordance with this invention will now be described with reference to FIG. 3 showing a vidicon-like tube 10 with a mixed-field electron-optical system according to the invention. More particularly, the vidicon-like tube 10 is shown to include an elongated glass envelope 11 having a target structure 12 at one end including an adjacent mesh 13 in a plane normal to the longitudinal axis Z of the envelope. An electron gun structure 14 is suitably mounted in envelope 11 at a distance from target structure 12 and includes, as an electron beam source, a cathode 15 from which electrons are emitted under the control of a grid electrode 16. The emitted electrons are accelerated by an anode electrode 17 which is maintained at an appropriate positive potential in respect to cathode 15. An electrode 18 is positioned adjacent anode 17 and has an aperture 19 defining a real object of the electron-optical system and being coincident with the axis Z of envelope 11. The diameter of aperture 19 is comparable to the desired sopt size of the electron beam on target 12.

The electron-optical system of vidicon-like tube 10 is shown to include a solenoid 20 extending around envelope 11 along a substantial portion of the length of the latter between electrode 18 and target structure 12, and an electrostatic yoke 21 which may be attached to, or formed on the inner surface of envelope 11 between electrode 18 and target structure 12. Solenoid 20 is suitably energized from a power source (not shown) connected to terminals **20*a* and 20*b* and generates a constant magnetic field parallel to axis Z within envelope 11. If desired, a permanent magnet may be employed in place of solenoid 20** to provide a constant magnetic field.

Electrostatic yoke 21 may be of the type disclosed in U.S. Pat No. 3,319,110, so as to provide simultaneous horizontal and vertical deflection forces on the beam of electrons. Thus, for example, yoke 21 may be comprised of pairs of interleaved horizontal and vertical deflection electrodes which are attached or formed on the inner surface of envelope 11 by plating, coating or the like. Electrostatic yoke 21 generates, in response to the application of suitable push-pull voltages or deflection signals to terminals **21*a* and 21'*a* and to terminals 21*b* and 21'*b*, a rotatable, bi-axial, electric field orthogonal to the magnetic field generated by solenoid 20. Such electric field is essentially transverse, that is, substantially free of any components along the axis Z which would tend to effect defocusing and rotation of the beam. It will be apparent from the foregoing that solenoid 20 and electrostatic yoke 21 generate crossed magnetic and electric fields which are generally coextensive within envelope 11 between electrode 18 and target structure 12. The magnetic field is static or constant, whereas the electric field is dynamic or varying in accordance with the deflection signals applied to terminals 21***a*, 21′*a* , 21*b* and 21′*b*. Although varying deflection signals or push-pull voltages are applied to the terminals of electrostatic yoke 21, the potential for a relatively long yoke can be averaged resulting in a surface potential distribution in accordance with the cosine law, and thereby providing a spatially uniform electric field distribution within the cavity 22 encompassed by yoke 21.

In the case of the vidicon-like tube 10, the uniform magnetic and electric fields which had been previously assumed for the theoretical attainment of normal beam landing on target structure 12 are not practically realized. More particularly, the magnetic field generated by solenoid 20 of finite length is inherently non-uniform in the axial direction by reason of flare field regions or fringes occurring at the opposite ends of the magnetic field. In the case of the electric or electrostatic field generated by electrostatic yoke 20, such electric field has field-free regions at its opposite ends as a result of the termination of the electric field by the electrode 18 having the object-defining aperture 19 therein and by the mesh 13 of target structure 12, respectively. The influence of electrode 18 and mesh 13 on the electric field extends into cavity 22 a distance equal to about 1 or 2 radii of cavity 22. The foregoing non-uniformities of the electric and magnetic fields greatly affect the normal beam landing performance of the tube.

In order to provide an understanding of the extent to which the normal beam landing is affected in vidicon-like tube 10, the landing errors resulting from the field-free regions at the opposite ends of the electric field and the landing errors resulting from the flare field regions at the opposite ends of the magnetic field have been individually analyzed. For the purposes of such analysis, the diameter of cavity 22 is 24 mm, the distance from aperture 19 to mesh 13 is 110 mm, the limiting diameter of aperture 19 is 30 μm, the beam accelerating potential is 500 V, the applied deflection voltage is 150 $V_{p-p}$ and the beam is deflected about 8 mm in the direction of the X-axis.

In analyzing the beam landing errors, the latter have been expressed as ratios of thevelocities of the primary beam in the X- and Y-directions to the velocity in the Z-direction at the mesh 13 of target structure 12. Further, a simplified electric field distribution has been assumed to consist of field-free regions at the ends of cavity 22 and a uniform electric field region between such field-free regions. Further, it has been assumed that any axial component of the electric or electrostatic field is negligible so that each field-free region of the electric field does not change the focus condition.

If the solenoid is assumed to be of infinite length so that the magnetic field is uniform, as on FIGS. 4A and 4B, then the electron motion in the non-uniform electric field immersed in the uniform magnetic field can be analytically solved to obtain the below landing error:

$$\dot{x}/\dot{z} = \frac{2\alpha}{\omega v_o} \sin\left(\frac{a+c}{L}\pi\right) \sin\left(\frac{a-c}{L}\pi\right)$$

$$\dot{y}/\dot{z} = -\frac{2\alpha}{\omega v_o} \sin\left(\frac{a+c}{L}\pi\right) \cos\left(\frac{a-c}{L}\pi\right)$$

in which $L=a+b+c$ and is the distance from aperture 19 to mesh 13 of target structure 12, a is the length of the field-free region adjacent aperture 19, b is the length of the uniform portion of the electric field between the field-free regions, and c is the length of the field-free region adjacent mesh 13.

Figure 5:
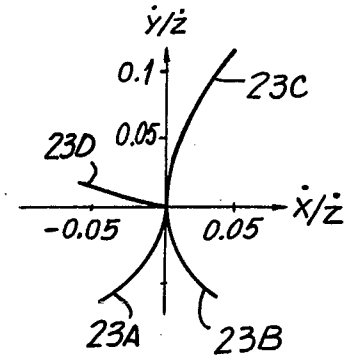
FIG. 5 is a graphic representation of the beam landing errors accompanying the magnetic and electric field variations shown on FIGS. 4A–4E.
Figure 4A:
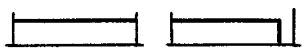
FIGS. 4A–4E diagrammatically illustrate variations along the axis of the magnetic and electric fields for various conditions of a mixed field electron-optical system.
Figure 4B:
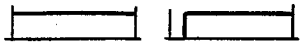

The error quantities corresponding to the first conditions of FIGS. 4A and 4B are separately plotted as curves 23A and 23B, respectively, on FIG. 5. In each instance, the field-free region has a length that is approximately 10 percent of the overall length L of cavity 22. Therefore, the error $\dot{y}/\dot{z}=-0.1$ is so large as to preclude the use of the yoke 21 immersed in a magnetic field of even infinite length in a camera tube.

The causes of the landing errors can be interpreted in terms of the nature of the respective deviations from a uniform condition of the electric or electrostatic field. When the field-free region of the electrostatic field is present near the target structure 12, the collimating action by the electrostatic field is reduced. Thus, while an electron is in such field-free region, the electron moves along a circular segment without changing the magnitude of its velocity and, as shown by the curve 23A on FIG. 5, the landing error is in the third quadrant.

When the field-free region of the electric or electrostatic field is near the aperture 19 in electrode 18, an electron does not quite complete one cycloid of motion at the mesh 13 of target structure 12 because the electron moves along a straight path while in the field-free region and, therefore, as shown by the curve 23B on FIG. 5, the landing error is in the fourth quadrant.

Figure 4C:
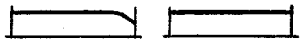
Figure 4D:
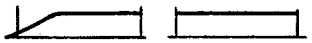

The electron motion in a mixed field of a non-uniform magnetic field and a uniform electrostatic field has also been studied by means of computer simulations. In connection with the foregoing, a solenoid of semiinfinite length has been assumed and the effect of a flare field region at each end has been examined separately, with the results being plotted as curves 23C and 23D, respectively, on FIG. 5. When the magnetic flare field region is near the target, as represented on FIG. 4C, the resulting landing error represented by the curve 23C on FIG. 5 is in the first quadrant. The foregoing results from the fact that a tangential force is exerted on the beam by the radial magnetic field component. When the magnetic flare field region is near the aperture 19, as represented on FIG. 4D, the resulting landing error represented by the curve 23D on FIG. 5 is shown to be in the second quadrant.

On the basis of the foregoing analyses and simulations of the non-uniformities of the magnetic and electric fields considered individually, the following properties of a mixed electron-optical system have been determined:

(1) The landing errors resulting from non-uniformities of the fields can be expressed by vector quantities. The directions of the vectors representing field-free regions at the opposite ends of the electric field and flare field regions at the opposite ends of the magnetic field, respectively, are in four different quadrants. The magnitudes of the vector quantities increase with increases in the lengths of the field-free regions or flare field regions.

(2) The resultant or overall landing error in an actual mixed field electron-optical system is approximated by the vectorial sum of the four vectors representing the landing errors due to the field-free regions of the electric field and the flare field regions of the magnetic field, respectively.

(3) The magnitudes of the vectors are approximately directly proportional to the electric or electrostatic field.

Figure 4E:
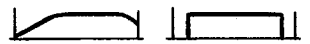

Based on the above, in accordance with the present invention, the length and location of solenoid 20 and the configuration and location of electrostatic yoke 21 are selected or determined so that, although the electric field has field-free regions at its opposite ends and the magnetic field has flare field regions at its opposite ends, as shown on FIG. 4E, the landing errors caused by such non-uniformities in the electric and magnetic fields substantially cancel each other and thereby provide a mixed field electron-optical system that is substantially free of landing error, that is, a system having normal beam landing on the target structure even though the magnetic and electric fields are non-uniform.

It has been found that, in a vidicon-like tube as described above with reference to FIG. 3, the landing errors due to non-uniformity of the magnetic field can substantially cancel the landing errors due to non-uniformity of the electric field so as to provide landing errors $\dot{x}/\dot{z}=0.006$ and $\dot{y}/\dot{z}=0.003$ which do not represent substantial departures from the desired normal beam landing.

Although an illustrative embodiment of the invention has been described in detail herein with reference to the accompanying drawing, it is to be noted that the invention is not limited to that precise embodiment, and that various changes and modifications may be effected therein by one skilled in the art without departing from the scope or spirit of the invention as defined in the appended claims.

What is claimed is:

1. In an electron-optical system comprising an envelope having an axis, a target structure in said envelope extending normal to said axis, an electron gun structure in said envelope directing a beam of electrons toward said target structure and including means defining an object of the electron optical system which is spaced in the direction along said axis from said target structure, magnetic field means for generating a constant magnetic field along said axis within a cavity of said envelope between said object and said target structure, and electric field means for generating a variable electric field within said cavity orthogonal to said magnetic field and capable of causing deflection of said beam along two coordinates in a plane orthogonal to said axis so that said magnetic and electrical fields are respectively operative in said cavity to project a focused image of said object upon said target structure and to simultaneously scan said image across the surface of said target structure; said magnetic and electric fields being non-uniform in the direction along said axis, and said magnetic field means being located and dimensioned so that landing errors of said beam on said target structure due to the non-uniformity of said electric field are substantially cancelled by landing errors of the beam due to the non-uniformity of said magnetic field.

2. An electron-optical system according to claim 1; in which said electric field has field-free regions adjacent its opposite ends due to the proximity of said means defining the object and said target structure, respectively, said magnetic field has flare field regions at its opposite ends, and said flare field regions and said field-free regions cause landing errors having vector representations in first and second quadrants and in third and fourth quadrants, respectively, with said vector representations substantially cancelling each other.

3. In an electron-optical system having an envelope with an axis, a target structure in the envelope extending normal to said axis, an electron gun structure in the envelope directing a beam of electrons toward the target structure and including means defining an object of the electron optical system which is spaced in the direction along said axis from said target structure, magnetic field means for generating a constant magnetic field along said axis within a cavity of the envelope between said object and said target structure, and electric field means for generating a variable electric field within said cavity orthogonal to said magnetic field and capable of causing deflection of said beam along two coordinates in a plane orthogonal to said axis so that said magnetic and electrical fields are respectively operative in said cavity to project a focused image of said object upon said target structure and to simultaneously scan said image across the surface of said target structure: a method of eliminating beam landing errors comprising dimensioning and locating said electric field means to provide said electric field with field-free regions proximate to said means defining said object and said target structure, respectively, and dimensioning and locating said magnetic field means to provide said magnetic field with flare field regions at its opposite ends producing landing errors which have vector representations substantially cancelling the vector representations of landing errors due to said field-free regions, respectively.

* * * * *